United States Patent [19]

Ohara

[11] Patent Number: 4,606,536

[45] Date of Patent: Aug. 19, 1986

[54] STOPPER PLATE APPARATUS FOR AUTOMATIC DOCUMENT FEEDER

[75] Inventor: Koji Ohara, Huntington Beach, Calif.

[73] Assignee: Ricoh Electronics, Inc., Irvine, Calif.

[21] Appl. No.: 722,852

[22] Filed: Apr. 12, 1985

[51] Int. Cl.[4] ..... B65H 3/06

[52] U.S. Cl. ..... 271/118; 271/246

[58] Field of Search ..... 271/118, 117, 121, 122, 271/167, 169, 145, 245, 246, 162, 164, 157

[56] References Cited

U.S. PATENT DOCUMENTS

| | | | |
|---|---|---|---|
| 3,588,097 | 6/1971 | Engel | 271/157 X |
| 4,073,391 | 2/1978 | O'Brien | 271/246 X |
| 4,083,553 | 4/1978 | Beck | 271/117 X |
| 4,203,588 | 5/1980 | Joosten | 271/246 |

OTHER PUBLICATIONS

IBM Technical Disclosure Bulletin, vol. 14, No. 5, pp. 1534, Oct. 1971, "Cut Sheet Feed Device", J. C. Rogers.

*Primary Examiner*—Richard A. Schacher
*Attorney, Agent, or Firm*—Walter A. Hackler

[57] ABSTRACT

Apparatus for automatically feeding individual sheets from a stack of individual sheets into a copy device provides for a guide plate and tray for holding a stack of individual sheets which are aligned and registered thereon by a movable stopper which engages the guide tray to enable such alignment. The stopper is hingably supported to allow for rotation thereof when moved out of engagement with the guide tray in order to prevent interference with the feeding of the individual sheets and damage thereto. Primary rollers are provided for feeding of individual sheets from the top of a stack of sheets and are supported above the stack of sheets for engagement and disengagement therewith to effect such feeding in coordination with movement of the stopper.

19 Claims, 11 Drawing Figures

FIG. 2.
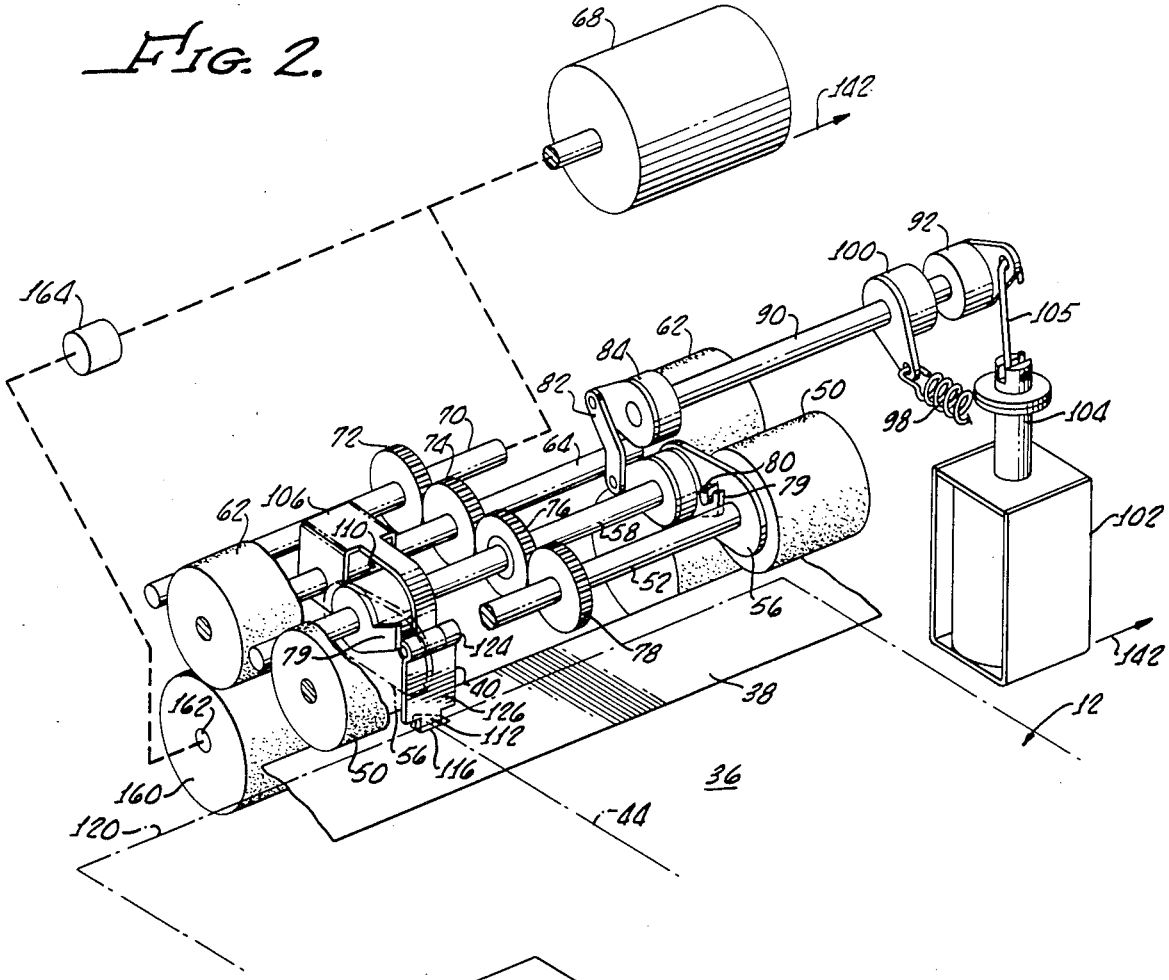
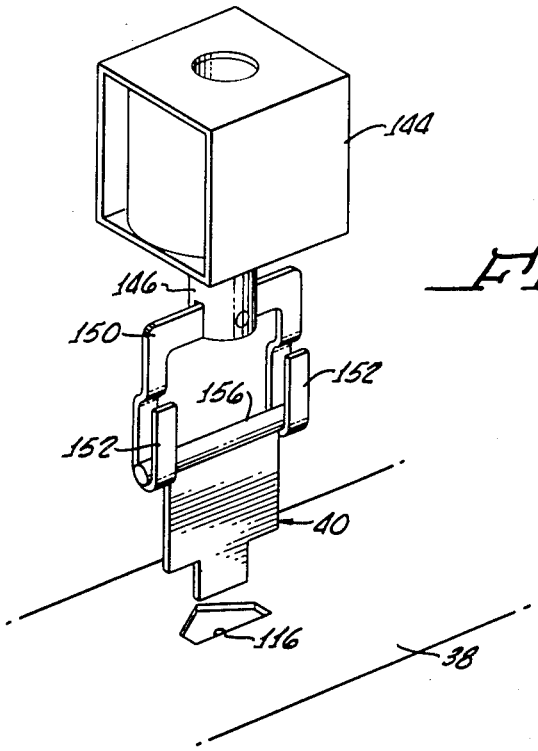
FIG. 3.

STOPPER PLATE APPARATUS FOR AUTOMATIC DOCUMENT FEEDER

The present invention is generally related to document feeders for copy machines and the like, and more particularly, directed to apparatus for the feeding of individual sheets from a stack of individual sheets.

Early copy machines were typically of a manual type in which sheets to be copied were aligned by hand on a glass plate, or the like, for copying.

Today, many copy machines incorporate a semiautomatic document feeder (SADF) into which the individual sheets to be copied are hand fed with the SADF transporting and aligning the individual sheet automatically into the copier.

Modern copy machines with fully automatic document feeders, on the other hand, require no individual handling of the sheets, rather, a stack of individual sheets is placed on a tray and an automatic document feeder withdraws individual sheets from the tray and transports them into the copy machine for copying. This operation continues until all of the sheets in the stack are fed into the machine, at which time the copy machine automatically shuts down.

It should be readily apparent that since most copy machines accept sheets of material on an individual and serial basis, individual sheets must be independently and separately fed to the copy machine in order to ensure that the machine operates without multiple duplication of the sheets or jamming of the copy machine feed mechanism.

In order to ensure a steady flow of individual sheets from a stack of sheets, the stack must be initially positioned in a tray, or the like, with proper alignment so that uniform feeding of the sheets may progress through the use of feed rollers, or the like.

It is particularly important that the leading edge of the sheets be properly aligned so that they may be engaged by a feed mechanism and transported from the stack into the copy machine. It should also be apparent that this alignment must be accomplished without later interference with the feed mechanism.

The present invention provides apparatus for use in a copy machine for supporting a stack of individual sheets and feeding individual sheets from the stack into the copy machine on a one-by-one, serial basis.

Alternatively, apparatus of the present invention may be incorporated into a separate module for use with a copy machine having a SADF. In this embodiment, the apparatus accepts a stack of individual sheets and feeds them into the SADF for later feeding into the copy machine.

SUMMARY OF THE INVENTION

In accordance with the present invention, apparatus for automatically feeding individual sheets from a stack of individual sheets includes support means for holding a stack of individual sheets, stopper means for releasably engaging the stack in order to position the stack on the support means and for preventing premature feeding of individual sheets from the stack, and primary feed roller means positioned over a top sheet of the stack.

Means are provided for supporting the primary feed roller means and for causing the primary feed roller means to selectively engage and disengage the top sheet. Upon engagement with the top sheet, the feed roller means feeds the top sheet outwardly from the stack.

Means are also provided which are in an operative relationship with the means for supporting the primary feed rollers, for disengaging the stopper means from the stack to enable the feed roller means to feed into the individual sheets therefrom.

More particularly, the support means include a tray and a guide plate for holding the stack of sheets and the stopper means includes at least one movable stopper plate for releasably engaging the guide plate and stack in order to position the stack on the support means.

Additionally, the apparatus in accordance with the present invention may include a secondary feed roller means disposed in an operative relationship with the primary feed roller means, for engaging and feeding the top sheet after it has been moved from the stack by the primary rollers. The secondary roller means may include means for preventing the feeding therepast of more than one sheet.

In order to provide for engagement with the stopper plate, the guide plate may include means defining an opening, or hole, therein for engaging a movable stopper means. Further, the opening so defined in the guide plate may become narrower in the direction of the feeding of individual sheets. This feature reduces the possibility of the leading edge of the individual sheet being fed from engaging, or hanging up, on the slot as it passes thereby.

It is also important that the stopper plate is rotatably mounted to the bracket means for enabling the stopper plate to be rotated by individual sheets, as the individual sheets are fed therepast.

When the stopper plate is engaging the hole in the guide plate, it provides for a rigid, fixed plate for alignment of the leading edges of the individual sheets and the stack thereagainst. However, when lifted and withdrawn from the hole, the rotatable mounting of the stopper plate to the bracket enables free movement of individual sheets therepast, without interference of the feeding of the individual sheets.

BRIEF DESCRIPTION OF THE DRAWINGS

The advantages and features of the present invention will appear from the following description when considered in conjunction with the accompanying drawings, in which:

FIG. 2 is an exploded perspective view of the apparatus of the present invention more clearly showing the cooperation between the feed rollers and the stopper plate;

FIG. 3 is an enlarged perspective view of an alternative embodiment of the stopper plate and supporting bracket showing its relationship with a hole defined in the guide plate.

DETAILED DESCRIPTION

Figure 1:
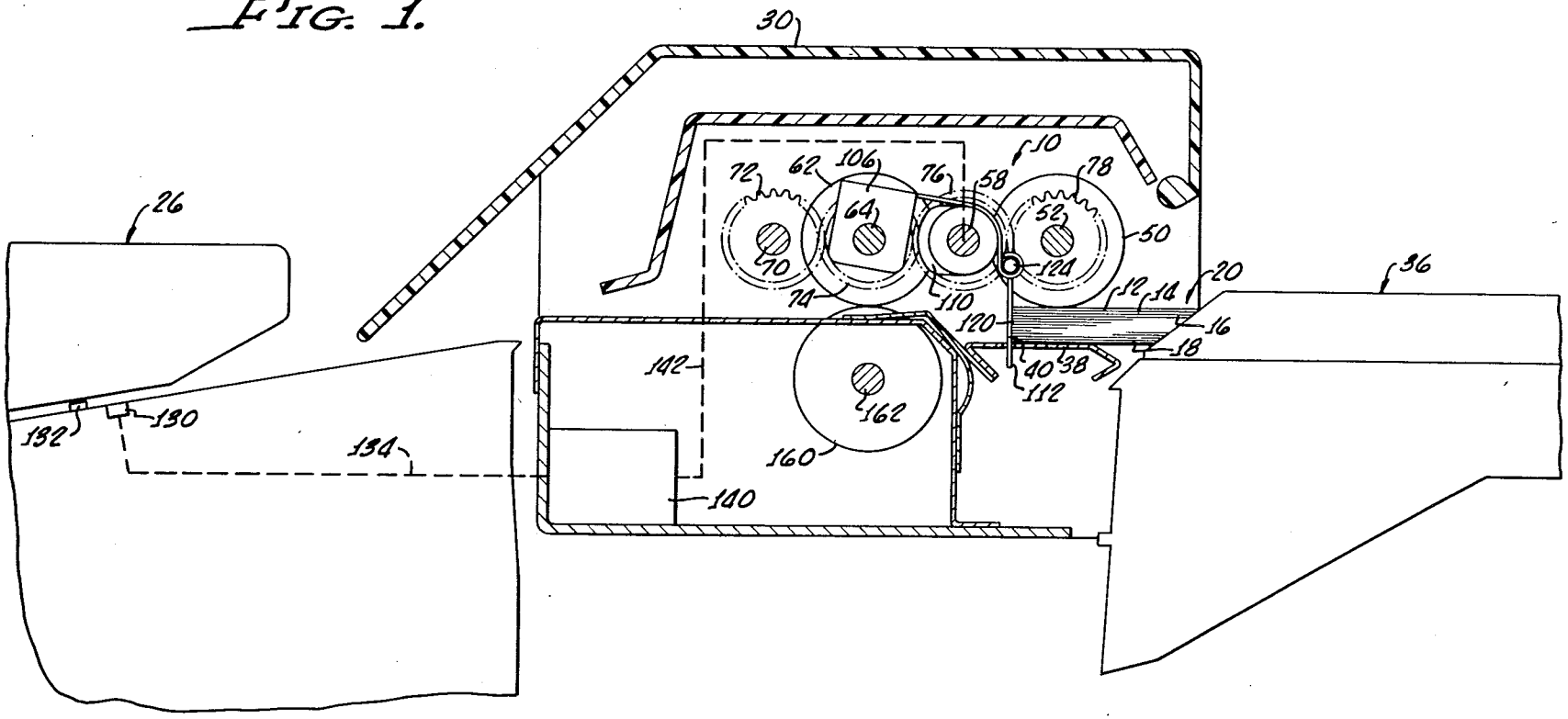
FIG. 1 is a cross-sectional view of an embodiment of the present invention, which may be utilized with an SADF to provide for fully automatic feeding of individual sheets from a stack of documents, generally showing an SADF entrance, a tray and guide plate for supporting a stack of individual sheets along with a stopper plate, bracket means and a set of primary and secondary rollers for feeding of the individual sheets.

Turning now to FIG. 1, there is shown, in cross-section, apparatus 10 in accordance with the present invention for automatically feeding individual sheets 12, 14, 16, 18 from a stack 20, is shown in an operative relationship with a semi-automatic document feeder (SADF) 26 for feeding of individual sheets 12, 14, 16, 18 thereinto.

As shown in FIG. 1, the apparatus of the present invention is shown as embodied in a module separate from the SADF and removably attached thereto by conventional means (not shown).

It should be appreciated that the apparatus of the present invention may be included in an SADF, or copy machine, as an integral part thereof. Hence, while the apparatus of the present invention is presently described in a separate module embodiment, the apparatus and operation thereof would be the same if embodied in and integrated in a copy machine.

The apparatus 10 may be enclosed in any suitable housing 30 supporting the apparatus 10 therein.

As shown, the apparatus 10 includes a tray 36 and a guide plate 38 which provides means for supporting and holding the stack 20 of individual sheets.

Reference to the sheets 12, 14, 16, 18 is meant to include any material suitable for use in a copy machine which includes paper, as well as specially treated plastics, and the like, suitable for overhead projection.

As will be hereinafter described in greater detail, one or more stopper plates 40 provides means for releasably engaging the stack 20 in order to position the stack on the guide plate 38 and tray and, additionally, for preventing premature feeding of individual sheets 12, 14, 16, 18 from the stack.

When a single stopper plate 40 is utilized, it is preferred that the stopper plate be positioned generally along a centerline 44 of a sheet 12, as more clearly shown in FIG. 2.

It should be appreciated that a plurality of stopper plates (not shown) may be connected in an identical manner as shown in connection with the single stopper plate 40, with each of the stopper plates in a spaced-apart relationship for positioning the stack 20 on the tray 36 and guide plate 38.

A pair of primary feed rollers 50 are provided for feeding a top sheet 12 outwardly from the stack 20 when the primary feed rollers 50 engage the top sheet 12 and are rotated.

The primary feed rollers 50 are fixed to a primary feed roller shaft 52, which is rotatably mounted between two arms 56, which in turn are pivotally mounted to a middle shaft 58.

A pair of secondary feed rollers 62 are mounted on a secondary feed roller shaft 64 in an operative relationship with the primary feed rollers 50 for engaging and feeding the top sheet 12 after it has been removed from the stack 20 by the primary feed rollers 50.

Rotation of the primary feed rollers 50 and secondary feed rollers 62 is enabled through a motor 68 interconnected by a drive shaft 70 and a set of gears 72, 74, 76, 78 sized and mounted on a drive shaft 70, secondary drive shaft 64, middle shaft 58, and primary drive shaft 52, in order to provide proper speed and coordination of the primary and secondary feed rollers 50, 62 for the movement of individual sheets 12, 14, 16, 18 of material therepast.

A pair of lift arms 79, best seen in FIG. 2, are mounted to the middle shaft 58 and engage tabs 80 disposed in the arms 56 to enable raising and lowering of the primary feed rollers 50 to thereby selectively engage and disengage the top sheet 12.

The arms 56 are interconnected by linkage 82 to an upper lift arm 84, which is interconnected by a shaft 90 to a solenoid arm 92.

The primary feed rollers 20 are maintained in a disengaged, or raised position, prior to feeding of sheets 12, 14, 16, 18, by a spring 98 interconnected to the shaft 90 by a spring arm 100.

As will be discussed hereinafter, in connection with the operation of the apparatus 10 of the present invention, the primary feed rollers 50 are lowered when a solenoid 102 is actuated, thereby pulling a plunger 104 and linkage 105 connected to the solenoid arm 92 which causes rotation of the shaft 90 and subsequent rotation of the lift arm in a clockwise rotation, thereby lowering the primary feed rollers 50.

It should be appreciated that the weight of the feed rollers 50, shaft 52, and the gear 78 provide the primary downward force onto the top sheet 12 of the paper, thereby providing a uniform consistent engagement force thereagainst, despite the height of the stack 20, within the limits of the vertical movement of the primary rollers 50.

It should be pointed out that, while the stack 20, as shown in the figures, consist of a top sheet 12, intermediate sheets 14–16 and a bottom sheet 18, any number of sheets may be utilized in the stack, limited only by the vertical movement of the primary rollers 50.

Turning again to FIG. 2, a bracket 106 for supporting the stopper plate 40 is rotatably mounted on the secondary roller shaft 64 and a stopper cam 110 is fixed on the middle shaft 58 for rotation therewith.

The cam 110 is sized and positioned on the shaft 58 so that when the solenoid 102 is not energized and the primary rollers 50 are positioned above the top sheet 12, the bracket 106 supporting the stopper plate 40, positions a narrow end 112 of the stopper plate within an opening, or hole, 116 formed in the guide plate 38.

With the stopper plate end 112 protruding into the hole 116, the stack 20 may be loaded onto the tray 36 and guide plate 38 and pushed forward until the leading edges 120 come in contact therewith, thereby positioning and aligning the stack 20 on the tray 36 and guide plate 38.

The stopper plate 40 is rotatably mounted to the bracket 106 by means of a pin 124 to enable the stopper plate 40 to freely rotate thereabout, when the bracket 106 is raised through rotation of the cam 110 caused by rotation of the middle shaft 58 by the solenoid 102 through the linkage 82 and shaft 90.

To reduce the size of the hole 116, necessary to engage the stopper plate 40, the stopper plate 112 may be narrower than the remaining upper portion 126 and should be appreciated that many stopper plate shapes may be utilized to achieve this result.

With regard to the hole 116, it should be appreciated that it should be positioned in the guide plate 38 and shaped in order that the width of the slot becomes narrower in direction of the individual sheet 12, 16, 18 feed direction.

As shown in FIG. 2, this may be generally triangular-shaped, however, a hemispherical shape may also be utilized. The purpose of this shaped hole is to prevent catching of the last sheet 18 thereon as it is fed therepast.

When used in conjunction with the SADF, a sensor 130 (see FIG. 1) is provided proximate a paper stop 132 in order to indicate when a sheet has been entered into the SADF.

The sensor 130 is interconnected by an electrical line 134 to a control circuit 140, which in turn is interconnected via an electrical line 142 to energize a solenoid 102 and the motor 68 to coordinate operation of the apparatus 10 with the SADF 126.

It should also be appreciated that the hinged stopper plate 40 may be independently operated by a separate solenoid 144, as shown in an alternate embodiment as shown in FIG. 3, having a plunger 146 connected to the stopper plate 40 by a bracket 150. The stopper plate 40 may be hingably attached to a pair of arms 152 of the bracket 150 by means of a pin 156.

In operation, this embodiment would utilize a simultaneous signal to both solenoid 102 and 144 in order to coordinate upward movement of the stopper plate 40 with the downward movement of the primary guide rollers 50.

Turning again to FIG. 1, in order to prevent more than one sheet from being fed from the stack 20, retard rollers 160 may be disposed beneath the secondary feed rollers 62 and driven by a shaft 162 interconnected via a conventional gear train and clutch assembly 164 with the motor 68.

Normally, the retard rollers 160 are driven in a clockwise manner, along with the secondary feed rollers 62, and push or hold sheets 14, 16 lying below the top sheet from being fed therewith. The clutch 164 is configured for making the retard rollers 160 turn in the feed direction if the secondary feed rollers 62 provides a sufficient driving force to the retard rollers. This sufficient force occurs when there is one sheet or no sheet between the secondary feed rollers 162 and the retard rollers 160.

However, if there is more than one sheet between the secondary feed rollers 62 and the retard rollers 160, the frictional engagement between the sheets 12, 14 and 16, does not transmit enough force on the retard rollers 160 to drive them in the feed direction. In this event, the extra sheets 12, 14 are rejected backwards to prevent simultaneous feed.

Figure 4A:
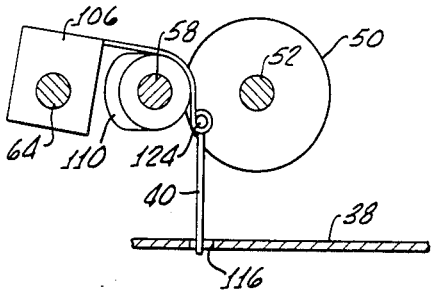
FIG. 4*a*, 4*b*, 4*c*, 4*d*, 4*e*, 4*f*, 4*g* and 4*h* comprise a set of drawings diagramming the operation of the present invention.
Figure 4E:
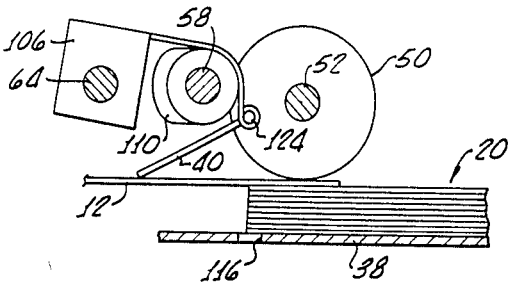
Figure 4B:
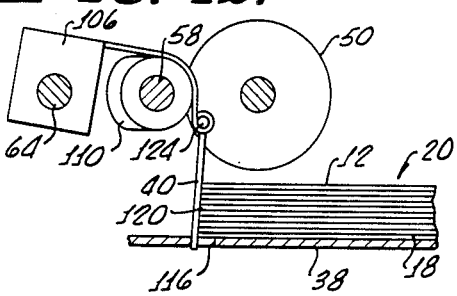
Figure 4F:
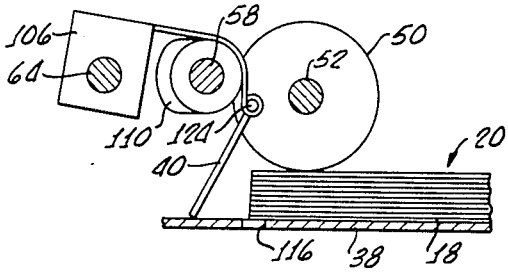

In operation, the apparatus, when used in conjunction with the SADF 26, is diagramed in FIGS. 4*a, b, c, d, e, f* and *g* and occurs as follows:

As shown in FIG. 4*a*, before use, the stopper plate 40 is disposed in the hole 116 of the guide plate 36, with the primary feed roller 50 positioned above the guide plate 38.

When a stack 20 of sheets 12, 14, 16, 18 are placed on the guide plate 38 and pushed forward, the stopper plate aligns all of the sheets within the stack along the leading edge 120 thereof beneath the primary feed roller 50.

A start button (not shown) may be pushed to energize the solenoid 102 and motor 68. As hereinbefore discussed, energizing the solenoid both lowers the primary feed rollers 50 and raises the stopper plate 40 so that it no longer engages the hole 116 and the guide plate 38.

Figure 4C:
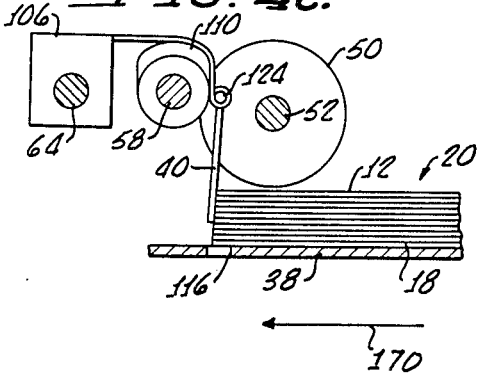
Figure 4G:
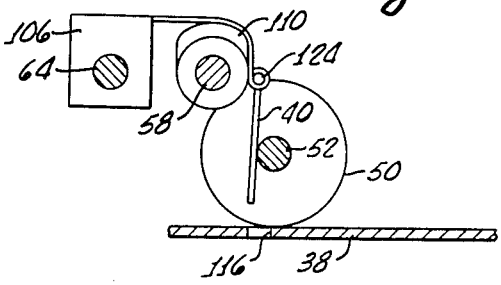
Figure 4D:
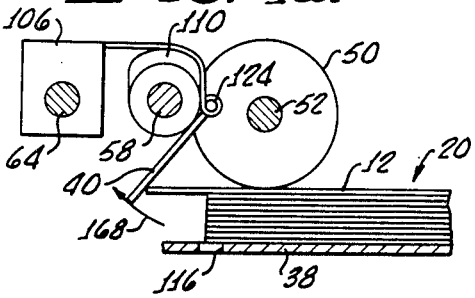
Figure 4H:
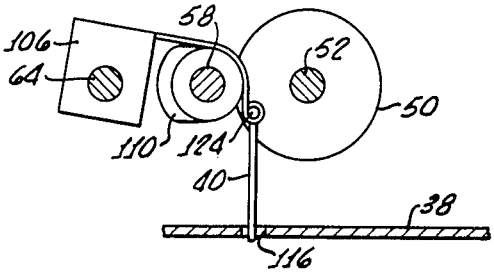

Rotation of the primary feed roller 50 by the motor 68 causes the top sheet 12 to be moved from the stack 20, as shown in FIGS. 4*c, d, e and f*. Additional sheets 14, 16 which may tend to move with the top sheet 12, are retarded by the retard rollers 160, as hereinbefore described, as not shown in FIG. 4, to clarify the feeding operation.

It is important that the stopper plate 40 is hinged about the pin 124 in order to enable the stopper plate 40 to swing outwardly in the direction of arrow 168, to enable the top sheet 12 to be fed therepast by the primary feed roller 50 in a feed direction 170. (See FIGS. 4*c, d, e* and *f*).

The sheet 12 passes through the secondary feed rollers 62 and retard rollers 160 into the semi-automatic document feeder 26 until it reaches the stopper 132 therein.

At this time, the sensor 130 senses arrival of a sheet and a signal is sent from the sensor to the control circuit 140, which disengages the primary feed rollers 50 from the top sheet 12 to remove unnecessary resistance on the SADF 26 when it feeds the sheet, and to reduce the chance of simultaneous feed.

At this point, the stopper plate may be resting on the top of a sheet spanning the hole, or it may be in the hole. When the SADF feeds the sheet, the sensor 130 detects the removal of the sheet and sends another signal to the control circuit 140 to start another feed cycle. This continues until all the sheets have been fed from the stack 20.

After the last sheet has been fed, the control circuit 140 once again energizes the solenoid to enable a last cycle, (FIGS. 4*g* and *h*) that is, a raising of the stopper plate and a lowering of the primary feed roller 50 and a raising of the primary feed roller 50 and a lowering of the stopper plate 40 into the hole 116.

This last cycle is utilized to ensure that the stopper plate 40 drops vertically into the hole 116 and does not end up on the top surface of the guide plate 38, which would prevent proper alignment of the stack during the next operation of the apparatus 10.

Although there has been hereinabove-described a specific arrangement of apparatus for automatic feeding individual sheets from the stack of individual sheets in accordance with the present invention, for purposes of illustrating the manner in which the invention may be used to advantage, it should be appreciated that the invention is not limited thereto. Accordingly, any and all modifications, variations, or equivalent arrangements which may occur to those skilled in the art, should be considered within the scope of the invention as defined in the appended claims.

What is claimed is:

1. Apparatus for automatically feeding individual sheets from a stack of individual sheets comprising:

support means for holding a stack of individual sheets;

stopper means for releasably engaging said stack in order to position said stack on said support means and for preventing premature feeding of individual sheets from said stack, said stopper means being mounted to enable the stopper means to moved by individual sheets as the individual sheets are fed therepast;

primary feed roller means positioned over a top sheet of said stack;

means for supporting said primary feed roller means and for causing said primary feed roller means to selectively engage and disengage said top sheet, said primary feed roller means feeding said top sheet outwardly from said stack when engaged with said top sheet; and means, in an operative relationship with said means for supporting said primary feed roller, for disengaging said stopper means from said stack and for enabling the primary feed roller means to feed individual sheets into and past said stopper means.

2. Apparatus for automatically feeding individual sheets from a stack of individual sheets comprising:

support means, including a tray and a guide plate for holding a stack of individual sheets;

movable stopper plate means for releasably engaging said guide plate and stack in order to position said stack on said support means, said movable stopper plate means being mounted to enable the movable stopper plate means to be moved by the individual sheets as the individual sheets are fed therepast;

primary feed roller means positioned over a top sheet of said stack;

means for supporting said primary feed roller means and for causing said primary feed roller means to selectively engage and disengage said top sheet, said primary feed roller means feeding said top sheet outwardly from said stack when engaged with said top sheet;

means, in an operative relationship with said means for supporting said primary feed roller means, for moving said movable stopper plate out of engagement with said guide plate and for enabling the primary feed roller means to feed individual sheets into and past the stopper plate means.

3. Apparatus for automatically feeding individual sheets from a stack of individual sheets comprising:

support means including a tray and a guide plate for holding a stack of individual sheets of material;

means, including at least one movable stopper plate for releasably engaging said guide plate and said stack in order to position said stack on said support means, said stopper plate being rotatably mounted to enable the stopper plate to be rotated by individual sheets as the individual sheets are fed therepast;

primary feed roller means positioned over a top sheet of said stack;

means for supporting said feed roller means and for causing said primary feed roller means to selectively engage and disengage said top sheet, said primary feed roller means feeding said top sheet outwardly from said stack of individual sheets when engaged with said top sheet;

means, in an operative relationship with said means for supporting the primary feed roller, for moving said movable stopper plate out of engagement with said guide plate and for enabling the primary feed roller means to feed individual sheets into and past the movable stopper plate.

4. The apparatus according to claim 3 wherein said guide plate includes means defining an opening therein for engaging said movable stopper means.

5. The apparatus according to claim 4 further comprising movable bracket means for supporting said stopper plate and for moving the stopper plate means to and from a position wherein a portion of the stopper plate enters the hole defined in the guide plate.

6. The apparatus according to claim 3 wherein the means for moving said movable stopper plate includes a solenoid interconnected with a bracket configured for rotatably supporting said stopper plate.

7. The apparatus according to claim 2 or 3 wherein the bracket means is configured for moving the stopper plate in a direction generally perpendicular to the guide plate.

8. The apparatus according to claim 4 wherein said portion of the stopper plate entering the hole defined in guide plate has a width less than the width of the remainder of the stopper plate.

9. The apparatus according to claim 2, 3, or 8 wherein said stopper plate, when engaging said guide plate, contacts a leading edge of the individual sheets in the stack at approximately a midpoint thereof.

10. The apparatus according to claim 4 or 8 wherein the hole defined in the guide plate narrows in the direction the individual sheets are fed.

11. The apparatus according to claim 10 wherein the hole defined in the guide plate has a generally triangular shape and is aligned in the tray so that the width of the hole decreases in the direction the individual sheets are fed.

12. The apparatus according to claim 10 wherein the hole defined in the tray has a generally hemispherical shape and is aligned in the tray so that the width of the hole decreases in the direction the individual sheets are fed.

13. The apparatus according to claim 1, 2, 3 or 5 wherein the means for supporting said feed rollers and for causing said primary feed rollers means to selectively engage and disengage said top sheet is operative for raising and lowering said primary feed roller means.

14. The apparatus according to claim 13 wherein the bracket means is attached to the means for supporting said primary feed roller means and moves therewith.

15. Apparatus for automatically feeding individual sheets from a stack of individual sheets comprising:

support means including a tray and a guide plate for holding a stack of individual sheets of material, said guide plate including means defining an opening therein for engaging a movable stopper plate;

means, including at least one movable stopper plate for releasably engaging said guide plate and said stack in order to position said stack on said support means;

movable bracket means for supporting said stopper plate and for moving the stopper plate to and from a position wherein a position of the stopper plate enters the opening defined in the guide plate, said stopper plate being rotatably mounted to said bracket means for enabling the stopper plate to be rotated by individual sheets as the individual sheets are fed therepast;

primary feed roller means positioned over a top sheet of said stack;

means for supporting said feed roller means and for causing said primary feed roller means to selectively engage and disengage said top sheet, said primary feed roller means feeding said top sheet outwardly from said stack of individual sheets when engaged with said top sheet; and means for moving said movable stopper plate out of engagement with said guide plate and stack when said feed roller means engages said top sheet.

16. The apparatus according to claim 1, 2, 3 or 15 further comprising secondary feed roller means, disposed in an operative relationship with said primary roller means for engaging and feeding said top sheet after it has been moved from the stack by the primary feed rollers.

17. The apparatus according to claim 16 wherein said secondary roller means includes means for preventing the feeding therepast more than one sheet.

18. The apparatus according to claim 17 wherein said means for preventing the feeding therepast more than one sheet comprises a retard roller means disposed beneath said secondary feed roller means for engaging undersides of sheets being fed therepast.

19. Apparatus for automatically feeding individual sheets from a stack of individual sheets comprising:

support means including a tray and a guide plate for holding a stack of individual sheets of material, said guide plate including means defining an opening therein;

stopper plate means for releasably engaging said guide plate opening and said stack in order to position said stack on said support means; said stopper plate means being rotatably mounted in a position so that it is aligned with the guide plate opening by the force of gravity and rotated by individual sheets as they are fed therepast;

primary feed roller means positioned over a top sheet of said stack;

means for supporting said feed roller means and for causing said primary feed roller means to selectively engage and disengage said top sheet, said primary feed roller means feeding said top sheet outwardly from said stack when engaged with said top sheet;

means for raising and lowering said stopper plate means; and control means interconnected with said means for moving said stopper plate for raising said stopper plate out of engagement with the guide plate hole after the bottom sheet is fed in order to align the stopper plate with the guide plate hole by force of gravity and thereafter lowering the stopper plate means to engage the guide plate hole.

* * * * *